US011102576B2

(12) United States Patent
Miller et al.

(10) Patent No.: US 11,102,576 B2
(45) Date of Patent: Aug. 24, 2021

(54) AUDIO DEVICE WITH AUDIO SIGNAL PROCESSING BASED ON ACOUSTIC VALVE STATE

(71) Applicant: Knowles Electronics, LLC, Itasca, IL (US)

(72) Inventors: Thomas Miller, Arlington Heights, IL (US); Shehab Albahri, Hanover Park, IL (US); Andrew Bellavia, Itasca, IL (US); Erik Wiederholtz, St. Charles, IL (US); Christopher Monti, Elgin, IL (US)

(73) Assignee: Knowles Electronicis, LLC, Itasca, IL (US)

( * ) Notice: Subject to any disclaimer, the term of this patent is extended or adjusted under 35 U.S.C. 154(b) by 136 days.

(21) Appl. No.: 16/237,420

(22) Filed: Dec. 31, 2018

(65) Prior Publication Data

US 2020/0213731 A1 Jul. 2, 2020

(51) Int. Cl.
*H04R 3/04* (2006.01)
*G10L 21/0232* (2013.01)
(Continued)

(52) U.S. Cl.
CPC ..... *H04R 3/04* (2013.01); *G10L 21/0232* (2013.01); *H04R 1/1016* (2013.01);
(Continued)

(58) Field of Classification Search
CPC combination set(s) only.
See application file for complete search history.

(56) References Cited

U.S. PATENT DOCUMENTS 2,301,744 A 5/1941 Olsen
3,835,263 A 9/1974 Killion
(Continued)

FOREIGN PATENT DOCUMENTS

CN 1130459 A 9/1996
DE 2614579 A1 10/1977
(Continued)

OTHER PUBLICATIONS

European Patent Office; Extended European Search Report; EP Application No. 09819815.3; dated Jul. 25, 2013.
(Continued)

*Primary Examiner* — Fan S Tsang
*Assistant Examiner* — Angelica M McKinney
(74) *Attorney, Agent, or Firm* — Faegre Drinker Biddle & Reath LLP

(57) ABSTRACT

Methods and apparatus change operation of a hearing device based on a state of an acoustic valve in the hearing device. In some examples an electrical circuit performs one or more of differing operations depending on a state of the acoustic valve. Some operations change the signal to a sound producing transducer and other operations change other operations of the hearing device. For example, an electrical circuit changes active noise cancelling operation, changes equalization settings, provides noise reduction improvements, provides beam forming changes and other operations based on a state of the acoustic valve. In some implementations, a change in acoustic valve state is used to change the operation of the hearing device.

30 Claims, 6 Drawing Sheets

(51) Int. Cl.

| | |
|---|---|
| ***H04R 3/00*** | (2006.01) |
| ***H04R 1/10*** | (2006.01) |
| ***G10L 21/0216*** | (2013.01) |
| ***G10L 21/0208*** | (2013.01) |

(52) U.S. Cl.
CPC ..... *H04R 1/1083* (2013.01); *H04R 3/005* (2013.01); *G10L 2021/02082* (2013.01); *G10L 2021/02166* (2013.01); *H04R 2460/03* (2013.01)

(56) References Cited

U.S. PATENT DOCUMENTS

| | | | | |
|---|---|---|---|---|
| 3,836,732 | A | 9/1974 | Johanson et al. | |
| 3,876,749 | A | 4/1975 | Horvath et al. | |
| 3,975,599 | A | 8/1976 | Johanson | |
| 4,133,984 | A | 1/1979 | Akiyama | |
| 4,142,072 | A | 2/1979 | Berland | |
| 4,605,197 | A | 8/1986 | Casey | |
| 4,756,312 | A | 7/1988 | Epley | |
| 4,800,982 | A | 1/1989 | Carlson | |
| 4,867,267 | A | 9/1989 | Carlson | |
| 4,893,655 | A | 1/1990 | Anderson | |
| 5,033,090 | A | 7/1991 | Weinrich | |
| 5,068,901 | A | 11/1991 | Carlson | |
| 5,220,612 | A | 6/1993 | Tibbetts et al. | |
| 5,259,035 | A | 11/1993 | Peters et al. | |
| 5,349,986 | A | 9/1994 | Sullivan et al. | |
| 5,357,576 | A | 10/1994 | Arndt | |
| 5,524,056 | A | 6/1996 | Killion et al. | |
| 5,631,965 | A | 5/1997 | Chang | |
| 5,692,060 | A | 11/1997 | Wickstrom | |
| 5,757,933 | A | 5/1998 | Preves et al. | |
| 5,785,661 | A | 7/1998 | Shennib | |
| 5,835,608 | A | 11/1998 | Warnaka et al. | |
| 5,990,425 | A | 11/1999 | McSwiggen | |
| 6,068,079 | A | 5/2000 | Hamery et al. | |
| 6,075,869 | A | 6/2000 | Killion et al. | |
| 6,134,334 | A | 10/2000 | Killion et al. | |
| 6,151,399 | A | 11/2000 | Killion et al. | |
| 6,549,635 | B1 * | 4/2003 | Gebert | H04R 25/456 381/324 |
| 7,136,497 | B2 | 11/2006 | McSwiggen | |
| 7,458,395 | B2 | 12/2008 | Haynes et al. | |
| 7,478,702 | B2 | 1/2009 | Berg | |
| 7,548,629 | B1 | 6/2009 | Griffin | |
| 7,740,104 | B1 | 6/2010 | Parkins | |
| 7,784,583 | B1 | 8/2010 | Hall | |
| 8,096,383 | B2 | 1/2012 | Saltykov | |
| 8,199,955 | B2 | 6/2012 | Akin | |
| 8,338,898 | B2 | 12/2012 | Schrank et al. | |
| 8,391,527 | B2 | 3/2013 | Feucht | |
| 8,798,304 | B2 | 8/2014 | Miller et al. | |
| 8,923,543 | B2 | 12/2014 | Sacha | |
| 9,185,480 | B2 * | 11/2015 | Howes | H04R 1/086 |
| 9,525,929 | B2 | 12/2016 | Burgett | |
| 9,706,290 | B2 * | 7/2017 | Grinker | H04R 11/02 |
| 10,869,141 | B2 * | 12/2020 | Albahri | H04R 25/65 |
| 10,887,705 | B2 * | 1/2021 | Lafort | H01F 7/064 |
| 2003/0059075 | A1 | 3/2003 | Niederdrank | |
| 2004/0046137 | A1 | 3/2004 | Herbert et al. | |
| 2006/0108552 | A1 | 5/2006 | Herbert et al. | |
| 2006/0137934 | A1 | 6/2006 | Kurth | |
| 2007/0075284 | A1 | 4/2007 | Masamura et al. | |
| 2007/0086599 | A1 | 4/2007 | Wilmink | |
| 2007/0176720 | A1 | 8/2007 | Janssen et al. | |
| 2008/0181443 | A1 | 7/2008 | Harvey et al. | |
| 2010/0111340 | A1 | 5/2010 | Miller et al. | |
| 2011/0182453 | A1 | 7/2011 | Van Hal | |
| 2012/0082335 | A1 | 4/2012 | Duisters | |
| 2014/0169579 | A1 | 6/2014 | Azmi | |
| 2014/0169603 | A1 | 6/2014 | Sacha et al. | |
| 2015/0041931 | A1 | 2/2015 | Szczech et al. | |
| 2016/0150310 | A1 * | 5/2016 | Bakalos | H04R 1/1083 381/372 |
| 2016/0255433 | A1 | 9/2016 | Grinker | |
| 2017/0055086 | A1 | 2/2017 | van Gilst | |
| 2017/0208382 | A1 * | 7/2017 | Grinker | G10K 11/17885 |
| 2017/0251292 | A1 | 8/2017 | Wiederholtz | |
| 2018/0091892 | A1 | 3/2018 | Taylor | |
| 2018/0109862 | A1 | 4/2018 | Lawand | |
| 2019/0116436 | A1 | 4/2019 | Lawland | |
| 2019/0116437 | A1 | 4/2019 | Bolsman | |
| 2019/0166238 | A1 | 5/2019 | Gilmore | |
| 2019/0208301 | A1 | 7/2019 | Monti | |
| 2019/0208343 | A1 | 7/2019 | Monti | |
| 2019/0215620 | A1 | 7/2019 | Albahri | |
| 2019/0215621 | A1 | 7/2019 | Albahri | |
| 2019/0320272 | A1 | 10/2019 | Jones | |

FOREIGN PATENT DOCUMENTS

| | | | |
|---|---|---|---|
| DE | 4422972 | A1 | 1/1996 |
| EP | 0455203 | A2 | 11/1991 |
| EP | 2747455 | A2 | 6/2014 |
| EP | 3177037 | A2 | 6/2017 |
| EP | 2835987 | | 8/2017 |
| FR | 2596644 | A1 | 10/1987 |
| KR | 10-0517059 | B1 | 9/2005 |
| KR | 1020080001568 | A | 1/2008 |
| WO | 1995007014 | A1 | 3/1995 |
| WO | 1997009864 | A1 | 3/1997 |
| WO | 1997030565 | A1 | 8/1997 |
| WO | 1998047318 | A1 | 10/1998 |
| WO | 1998057081 | A1 | 12/1998 |
| WO | 0027166 | A2 | 5/2000 |
| WO | 2006061058 | A1 | 6/2006 |
| WO | 2007107736 | A2 | 9/2007 |
| WO | 2008022048 | A2 | 2/2008 |
| WO | 2010042613 | A2 | 4/2010 |

OTHER PUBLICATIONS

European Patent Office; Extended European Search Report; EP Application No. 09819815.3; dated Dec. 22, 2016.
International Search Report and Written Opinion; International Application No. PCT/US2009/059829; dated May 20, 2010.
International Search Report and Written Opinion; International Application No. PCT/US2019/063321; dated Mar. 3, 2020.

* cited by examiner

AUDIO DEVICE WITH AUDIO SIGNAL PROCESSING BASED ON ACOUSTIC VALVE STATE

TECHNICAL FIELD

This disclosure relates generally to hearing devices and, more specifically, to hearing devices having acoustic valves.

BACKGROUND

Hearing devices are known generally and include hearing aids and earphones, among other personal audio devices. Some hearing devices are configured to provide an acoustic seal (i.e., a "closed fit") with the user's ear. The seal may cause occlusion effects including a sense of pressure build-up in the user's ear, a blocking of externally produced sounds that the user may wish to hear, and frequency-dependent amplification of the user's own voice among other undesirable effects. However, closed-fit devices have desirable effects including higher output at low frequencies and the blocking of unwanted sound from the ambient environment.

Other hearing devices provide a vented coupling (i.e., "open fit") with the user's ear. Such a vent allows ambient sound to pass into the user's ear. Open-fit devices tend to reduce the negative effects of occlusion but in some circumstances may not provide optimized frequency performance and sound quality. One such open-fit hearing device is a receiver-in-canal (RIC) device fitted with an open-fit ear dome. RIC devices typically supplement environmental sound with amplified sound in a specific range of frequencies to compensate for hearing loss and aid in communication.

An acoustic valve can be incorporated into a hearing device to allow control over passing sound between the ear canal and the outside world.

BRIEF DESCRIPTION OF THE DRAWINGS

The objects, features and advantages of the present disclosure will become more fully apparent to those of ordinary skill in the art upon careful consideration of the following Detailed Description and the appended claims in conjunction with the drawings described below.

Figure 1:
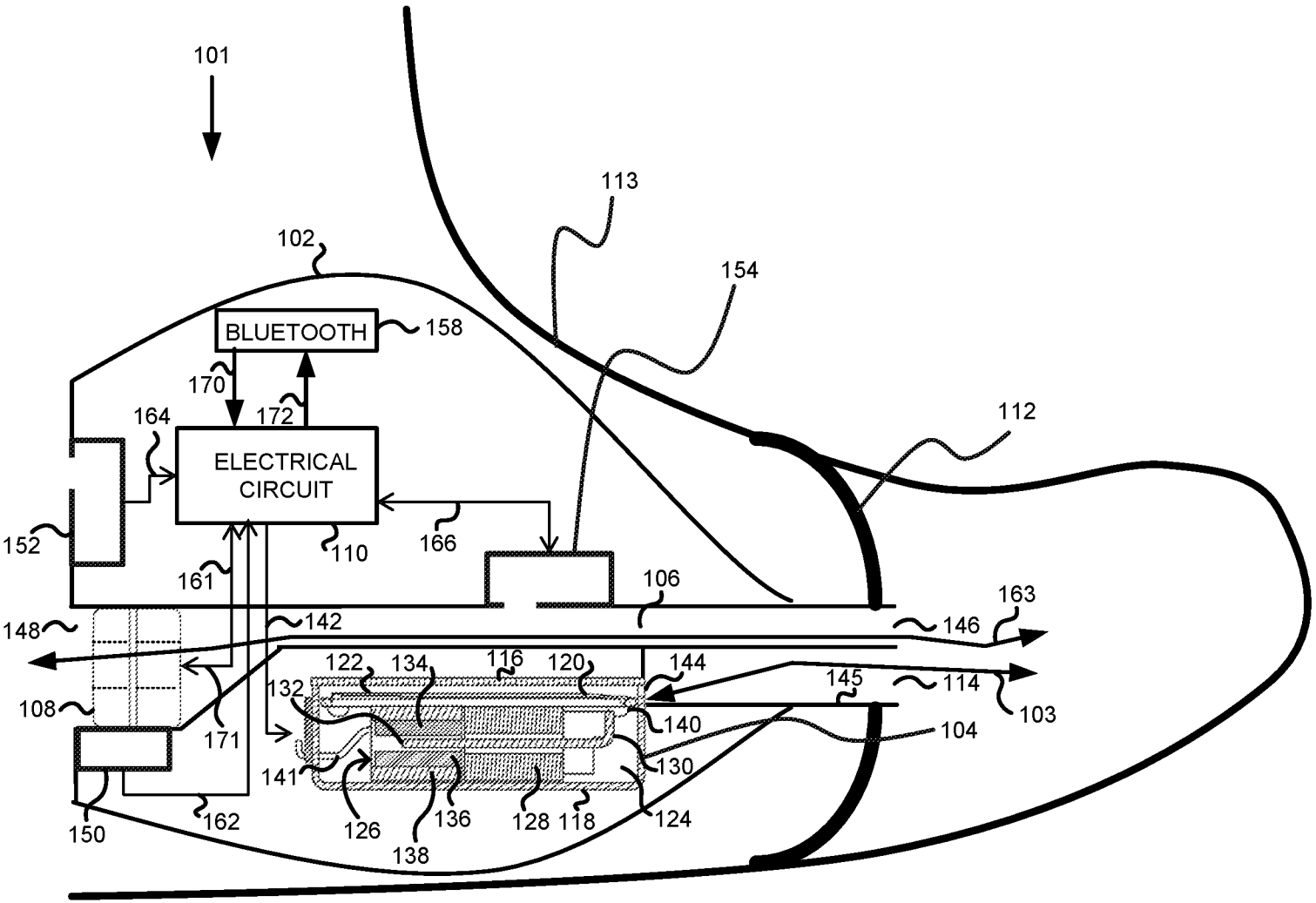
FIG. 1 is a diagram of a hearing device having an acoustic valve.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. The terms and expressions used herein have the ordinary technical meaning as is accorded to such terms and expressions by persons skilled in the technical field as set forth above except where different specific meanings have otherwise been set forth herein.

DETAILED DESCRIPTION

The present disclosure pertains to methods and apparatus for changing operation of a hearing device based on a state of an acoustic valve in the hearing device. In some examples an electrical circuit performs one or more of differing operations depending on a state of the acoustic valve. Some operations change the signal to a sound-producing electroacoustic transducer and other operations change other operations of the hearing device. For example, an electrical circuit changes active noise cancelling operation, changes equalization settings, provides noise reduction improvements, provides beam forming changes and other operations based on a state of the acoustic valve. In some implementations, a change in acoustic valve state is used to change the operation of the hearing device.

The teachings of the present disclosure are generally applicable to hearing devices including a speaker disposed in a housing having a portion configured to form a substantial seal with the user's ear. A substantial seal is not a perfect seal but rather a seal that blocks a significant portion of the audio spectrum. Use of the term "seal" and its variants herein means a "substantial seal" unless indicated otherwise. The seal may be formed by an ear tip or other portion of the hearing device. In some embodiments, the hearing device is a receiver-in-canal (RIC) device for use in combination with a behind-the-ear (BTE) device including a battery and an electrical circuit coupled to the RIC device by a wired connection that extends about the user's ear. The RIC typically includes a speaker disposed in a housing having a portion configured for insertion at least partially into a user's ear canal. In other embodiments, the hearing device is an in-the-ear (ITE) device or a completely-in-canal (CIC) device containing the speaker, electrical circuits and all other components. In another embodiment, the hearing device is a behind-the-ear (BTE) device containing the speaker, electrical circuits and other active components with a sound tube and other passive components that extend into the user's ear. The teachings of the present disclosure are also applicable to over-the-ear devices, earphones, ear buds, in-ear headphones with wireless connectivity, and active noise-canceling (ANC) headphones, among other wearable devices that form a sealed coupling with the user's ear and emit sound thereto. These and other applicable hearing devices typically include an electro-acoustic transducer operable to produce sound.

A sound-producing electroacoustic transducer, also referred to herein as a speaker, generally includes a diaphragm that separates a volume within a housing of the hearing device into a front volume and a back volume. A motor actuates the diaphragm in response to an excitation signal. Actuation of the diaphragm moves air from a volume of the housing and into the user's ear via a sound opening of the hearing device. Such a speaker may be embodied as a balanced armature receiver or as a dynamic speaker among other known and future sound-producing transducers.

In some embodiments, the hearing device includes an acoustic vent extending between a portion of the hearing device that is intended to be coupled to the user's ear (e.g., disposed at least partially in the ear canal) and a portion of the hearing device that is exposed to the environment. Actuation of an acoustic valve disposed in or along the acoustic vent alters the passage of sound through the vent thereby configuring the hearing device between a relatively open fit state and a relatively closed fit state. When the acoustic valve is open, sound travels through the passage and into the ear canal thereby reducing occlusion. Conversely, closing the acoustic valve creates a more complete acoustic seal with the user's ear canal which may be preferable for certain activities, such as listening to music. In other embodiments, the acoustic passage does not extend fully through the housing. For example, the passage may vent a volume of the speaker to the ambient atmosphere. Knowledge of the actual state of the valve may be used to ensure that the hearing device is configured properly (e.g., for open fit or closed fit operation) or for changing operation of the hearing device. Sensor feedback that provides information about the valve state is but one example and in other implementations it is not necessary for changing operation of the hearing device.

Figure 2:
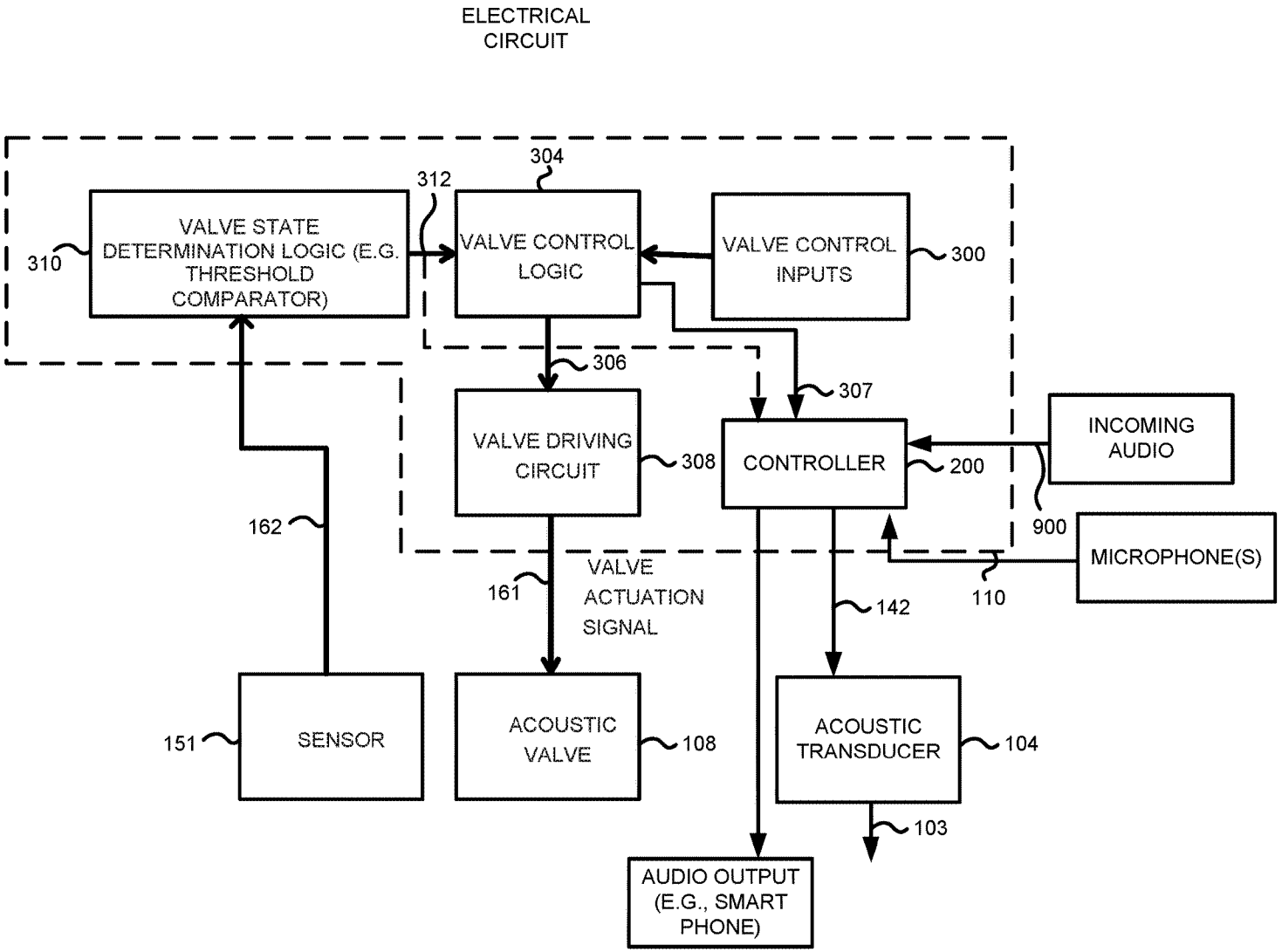
FIG. 2 is a schematic block diagram of a portion of a hearing device.

In FIGS. 1-2 the hearing device 101 includes a housing 102 (also referred to as a body), a speaker 104, an acoustic passage 106, an acoustic valve 108 disposed along the acoustic passage 106, and an electrical circuit 110 configured to actuate the acoustic valve 108 and perform other functions, if desired, as set forth below. The housing 102 has a contact portion 112 which comes into contact with the user's ear (e.g., the ear canal 113) when the hearing device 101 is in use. The contact portion 112 can be replaceable foam, a rubber ear tip, custom molded plastic, or any other suitable material and structure. The housing 102 also defines a sound opening 114 through which sound travels from the electro-acoustic transducer 104 into the user's ear. The electro-acoustic transducer 104 is disposed in the housing 102 and includes a diaphragm 120 which separates the inside volume of the housing into a front volume 122 and a back volume 124. In FIG. 1, the speaker is embodied as a balanced armature receiver including a speaker housing defined by a cover 116 and a cup 118, wherein the front volume 122 is partially defined by the cover 116 and the diaphragm 120 and the back volume is partially defined by the cup 118 and the diaphragm 120. More generally, however, the housing 102 may form a portion, or all, of the speaker housing. Other speakers may be employed including but not limited to dynamic speakers. Also, any suitable number of acoustic valves and corresponding passages and speakers may be employed.

In FIG. 1, the electro-acoustic speaker 104 includes a motor 126 disposed in the back volume 124. The motor 126 includes a coil 128 disposed about a portion of, or otherwise magnetically coupled to, an armature 130. A movable portion 132 of the armature is disposed in equipoise between magnets 134 and 136 which are retained by a yoke 138. The diaphragm 120 is movably coupled to a support structure 140, and wires 141 extend through the cup 118 of the electro-acoustic speaker 104 for connection to the electrical circuit 110. Application of an electrical excitation signal 142 to the coil 128, through wires 141, modulates the magnetic field, causing deflection of the armature 130 between the magnets 134 and 136. The deflecting armature 130 is linked to the diaphragm 120, wherein movement of the diaphragm 120 forces air through a sound port 144 of the housing, which is defined by the cover 116 and the cup 118 of the electro-acoustic speaker 104. Movement of the diaphragm 120 results in changes in air pressure in the front volume 122 wherein acoustic pressure (e.g., sound) is emitted through the sound port 144. Armature receivers suitable for the embodiments described herein are available from Knowles Electronics, LLC, however any suitable speaker can be employed. Dynamic speakers also include a motor disposed in a back volume, the operation of which is known generally to those of ordinary skill in the art.

The housing 102 includes the sound opening 114 located in a nozzle 145 of the housing 102. The sound opening 114 is acoustically coupled to the front volume 122, and sound produced by the speaker emanates from the sound port 144 of the front volume 122 through the sound opening 114 of the housing 102 and into the user's ear as an output acoustic signal 103. The nozzle 145 also defines a portion of the acoustic passage 106 which extends through the hearing device 101 from a first port 146 defined by the nozzle 145 and acoustically coupled to the user's ear, and a second port 148 which is acoustically coupled to the ambient atmosphere. In another example, the acoustic passage can be partially defined by the volume of the electro-acoustic speaker, although other suitable configurations may also be employed.

Generally, the hearing device may include a sensor for detecting the state of the acoustic valve. However, the state of the acoustic valve may also be assumed to change to another state based on an assumption that an electrical control signal sent to the valve to change the state of the valve actuated the valve as intended. If a sensor is employed, the sensor can take many forms including but not limited to, a circuit configured to sense impedance of a valve coil in the acoustic valve in response to a diagnostic signal applied to the valve coil, wherein the impedance of the valve coil is indicative of the state of the acoustic valve. In other embodiments the sensor is a microphone having an output coupled to the electrical circuit or a plurality of microphones positioned in the hearing device. In other embodiments the sensor is a magnetic, e.g., Hall Effect, sensor and/or a capacitive sensor that monitors the state of the acoustic valve. In some embodiments the sensor is embodied as contacts on the acoustic valve, wherein an electrical connection between the contacts is indicative of a state of the acoustic valve. Various examples are discussed herein.

FIG. 1 illustrates various alternative sensors for this purpose, wherein the electrical circuit 110 is coupled to a sensor 150, a first microphone 152, a second microphone 154 and the valve 108. In some embodiments, only one of the sensors shown is required to sense the state of the acoustic valve. Some sensors shown in FIG. 1 may also be used for other purposes. For example, multiple microphones used for active noise cancellation (ANC) or for beam forming may also be used to detect the state of the acoustic valve. The first microphone 152 is placed in or on the housing 102 to be acoustically coupled to the ambient atmosphere, and the second microphone 154 is placed in or on the housing, e.g., in the acoustic passage 106, to be acoustically coupled to the user's ear. The electrical circuit 110 provides a valve control signal 161 to the acoustic valve 108 in order to change the state of the valve 108 between open and closed states, as determined by the electrical circuit 110 or as determined by a remote device that sends a valve state change signal to the hearing device.

In some embodiments, the hearing device includes a wireless communication interface, e.g., Bluetooth, 158, which wirelessly couples the hearing device 100 to a master remote device such as a smart phone, wearable, an internet server, a gateway device or some other device. The hearing device may also include a near field wireless link. Such a link may be provided through near field magnetic induction (NFMI), for example. In embodiments where the hearing device includes first and second wireless hearable devices, such a link may couple a first wireless hearable device 101 in one ear of the user to a second wireless hearable device, such as a duplicate device 101 in the user's other ear so that acoustic control signals and other signaling can be shared between the hearable devices.

Generally, the acoustic valve is positioned in an acoustic passage of the housing and is actuatable by an electrical circuit to alter passage of sound, shown as arrow 163, through the acoustic passage. An acoustic valve state sensor, if used, generates an output signal indicative of a state (e.g., open or closed) of the acoustic valve or in other implementations the change of the valve state is assumed to occur when the electrical circuit outputs a valve control signal to change the state of the valve. In some implementations the electrical circuit may actuate the acoustic valve based on the output signal of the acoustic valve state sensor depending on the desired state of the valve. Various sensing techniques are employed in different embodiments to determine the current state of the acoustic valve.

The electrical circuit 110 in one example is an integrated circuit, for example a processor coupled to memory such as random access memory (RAM) such as dynamic RAM (DRAM), static RAM (SRAM), read only memory (ROM) and the like, or a driver circuit and includes logic circuitry, to run algorithms to determine state of the acoustic valve and otherwise control the acoustic valve. However, it will be recognized that some function or operation of the electrical circuit can be distributed among different components if desired, including in a remote device.

Referring to FIGS. 1 and 2, there are numerous ways of detecting valve state although in some embodiments no valve state detecting circuitry is needed. If valve state detection is desired, below are examples of detecting such state. For example, where the acoustic valve 108 includes one or more electrical coils, the electrical circuit includes a coil impedance measuring circuit configured to sense impedance of the valve coil in response to a valve diagnostic signal 171 applied to the valve coil by the electric circuit 110. In this example, the valve driving circuit 308 also generates the diagnostic signal 171. However, it will be recognized that the diagnostic signal can be generated by any suitable circuit. The impedance detected by the electrical circuit 110 in response to the valve diagnostic signal 171 is indicative of the state of the acoustic valve 108. For example, when a valve is closed, a first impedance results whereas when the valve is open a different impedance is detected from the valve coil. In one implementation, the electrical circuit applies an alternating current (AC) diagnostic pulse to the valve coil of the acoustic valve without actuation of the acoustic valve to obtain an impedance measurement. In one example, a brief low-amplitude sinusoidal voltage or current is applied to limit the amount of power used for diagnostic operation. The resulting current or voltage or both are monitored. Electrical impedance is calculated a V/I (voltage divided by current), wherein V and I are frequency dependent vector quantities that can be expressed as having a magnitude and phase or real and imaginary parts. At lower frequencies (e.g. <100 Hz) the real part of the impedance characterized by resistance of the valve coil and connections dominates. At higher frequencies (e.g. >100 Hz) the imaginary part of the impedance characterized by valve coil inductance becomes an important contributor to impedance. The impedance of the electrical circuit is dependent not just on the valve coil but also the geometry of nearby ferromagnetic or permanent magnet material. The location of a moving magnetic (ferromagnetic or permanent magnetic or both) component of the valve can then be indicated by differences in the electrical impedance of the circuit at some high frequency (e.g. 10,000 Hz.). Alternatively, the valve coil may be moving and the magnetic material may be stationary.

The valve circuit has a first electrical impedance at a frequency when the valve coil and surrounding magnetic material have a first relative position that is indicative of an open state. The valve circuit will have a second electrical impedance at the frequency when the valve coil and surrounding magnetic material have a second relative position that is indicative of a closed state. A third impedance may indicate that the acoustic valve is partially open or partially closed as may occur if the valve is damaged. The third state could also be an intended state of a multistate valve. If the valve is damaged, a failure notification may be provided or stored in a memory device of the hearing device. The failure notification can be in any suitable form in including but not limited to an LED indication on the hearable that has the problem, an audible notification through the acoustic speaker, the notification can be sent to the remote device which then generates a user notification through a user interface on the remote device or a signal to the hearable, or the failure notification can be sent to a server that logs the event. In the event that a valve may not be properly actuated to the desired state similar notification protocols may be employed. Instead of the hearables performing the impedance determination operation or other valve state determination operation, the impedance determination or valve state determination may be performed at the remote device, such as a smart phone, web server, wearable or other remote device. The remote device may then provide a valve actuation signal to the hearing device if actuation is required.

Instead of using a valve coil impedance measurement, the acoustic valve state sensor can be implemented as a microphone having an output that is received by the electrical circuit 110. In one implementation, a microphone, e.g., microphone 152 or 154 in FIG. 1, may sense sound associated with the actuation of the acoustic valve. In FIG. 2, the state determination logic 310 may determine the valve state change based on acoustic signatures associated with the transition into different valve states. Such signatures may be determined empirically for opening and closing of the valve and the signatures may be used by an algorithm executed at the hearing device or at a remote device to determine the state of the valve.

In another implementation, the acoustic valve state sensor may be embodied as multiple microphones. In FIG. 1, for example, the microphone 152 detects ambient sound 164 when a portion of the housing is coupled to the user's ear and the microphone 154 is located to detect sound 166 within the user's ear when the device is positioned in the user's ear. The electrical circuit determines the state of the valve based on output signals from the microphone 152 and 154. For example, a comparison of the microphone signals can indicate that the degree to which sound is passing between the ear canal of the user and the ambient atmosphere or between the ambient atmosphere and the ear canal of the user. In another example, the relationship between the frequency content of the first microphone and the frequency content of the second microphone is indicative of the state of the valve.

In another example, the acoustic valve state sensor is a magnetic, e.g., Hall Effect, sensor that generates a signal indicative of the state of the acoustic valve and transmits the detected signal to the electrical circuit 110. In this example, the magnetic sensor may detect movement of the ferromaterial (e.g., armature) in the acoustic valve. In yet another example, the acoustic valve state sensor is embodied as a capacitive sensor that detects a capacitance between moving and non-moving part of the acoustic valve, wherein different capacitance values are associated with different valve states. In another example, the acoustic valve state sensor may be implemented as contacts on the acoustic valve wherein an electrical connection between the contacts is indicative of a state of the acoustic valve. For example, the contacts are placed such that the contacts form an open or closed circuit depending on the state of the valve. The magnetic sensor, the capacitive sensor and the contacts sensors are represented schematically by the generic sensor 150 located proximate the acoustic valve.

In FIG. 1, a Bluetooth chip 158 serves as a wireless communication interface the supports the conveyance of content or voice between the hearing device and a remote device. In another example, the device 100 can be a hearing aid and microphone 152 passes received sound 164 for amplification and processing by the electrical circuit.

In FIG. 2, the electrical circuit 110 includes valve control inputs 300 that receive valve state control signals. The valve control inputs can be provided manually by the user or by a remote source or by an algorithm implemented on the hearing device. The valve control logic 304 provides a (e.g., open or close) signal 306 to the valve driver circuit 308 based on the valve control input 300. The valve driver circuit responsively provides an actuation signal 161 to acoustic valve 108. The actuation signal may be in the form of a short pulse of sufficient duration and amplitude to actuate the valve, wherein the polarity of the pulse may be changed to open or close the valve. The pulse may be a square-shaped pulse, half-sine, exponential, or any other suitable shape to achieve actuation. The acoustic valve 108 and the valve driving circuit 308 are disposed on an in-the-ear portion of the hearing device. However, the valve driving circuit can also be located in any other part of the hearing device that is coupled to the in-the-ear portion, for example, a BTE unit, or a collar, etc. The valve control logic 304 can be part of the electrical a circuit on the hearing device or it can be implemented on an electrical circuit of a remote device or on both.

FIG. 2 also shows the acoustic valve state sensor 151 that generates an output that may be indicative of the state of the acoustic valve. In some embodiments, an impedance measuring circuit generates an analogous signal. It will be appreciated that detecting valve state in not necessary. However, in embodiments where valve state detection is desired, the valve state determination logic 310 receives the output signal of the valve state sensor, if used, and may perform some processing thereon to determine the state of the acoustic valve. Such processing may include noise filtering, bandwidth filtering, comparison to a threshold, and other processing depending on the type of sensor. The valve state determination logic 310 sends a valve state signal 312 to the valve control logic 304. The valve control logic 304 provides an indication 307 that a valve state change occurred to the controller or the state of the valve (e.g., open or closed). The controller controls operation of the hearing device based on the valve state.

The valve state determination logic can be implemented in either the hearing device or in a remote device like a smart phone. In embodiments where the valve state determination functionality is performed in the remote device, the hearing device transmits the valve state sensor signal to the remote device. In this example, the remote device determines the valve state by processing the sensor signal and thereafter transmits the valve state information to the hearing device. The valve control logic may also be implemented in the hearing device or in the remote device. If the valve control logic is implemented in the remote device, the remote device communicates the valve actuation signal to the valve driving circuit in the hearing device.

The electrical circuit can be implemented in hardware or in both hardware and software (including firmware). For example, the valve state determination logic and the valve control logic can be implemented in a programmable processor. The sensors can be implemented as hardware. For example, the impedance measuring circuit can be implemented as a current measuring resistor or voltage measuring resistor or both.

In other implementations, control of operation of the hearing device 101 is done based on a state of the acoustic valve 108, such as whether the acoustic valve is open or closed (or in a state therebetween). A valve state can be determined using the sensor operations described above or without using valve state detection circuitry. For example, the electrical circuit that issues the valve actuation signal 161 knows whether it sent a signal that would open or close the valve or provided a signal for another valve state. Therefore, a change in valve state can be determined based on the valve actuation signal 161, or based on the decision to change valve state, instead of using a sensor configuration or other circuitry to detect a valve state.

Referring to FIGS. 1-5, a controller 200 (FIG. 2) is part of electrical circuit 110 and controls operation of the hearing device based on a state of the acoustic valve 104. By way of example the controller changes active noise cancelling operation, changes equalization settings, provides noise reduction improvements, provides beam forming changes and other operations based on a state of the acoustic valve. In some implementations, the controller and/or electrical circuit 110 is implemented as a processor, wherein the processor is configured to control operation by adapting the electrical excitation signal 142 applied to the speaker 104 based on the state of the acoustic valve (e.g., whether the valve is open or closed). The electrical circuit 110 receives incoming audio 303 from any suitable source or sources and processes the incoming audio as desired.

Figure 4:
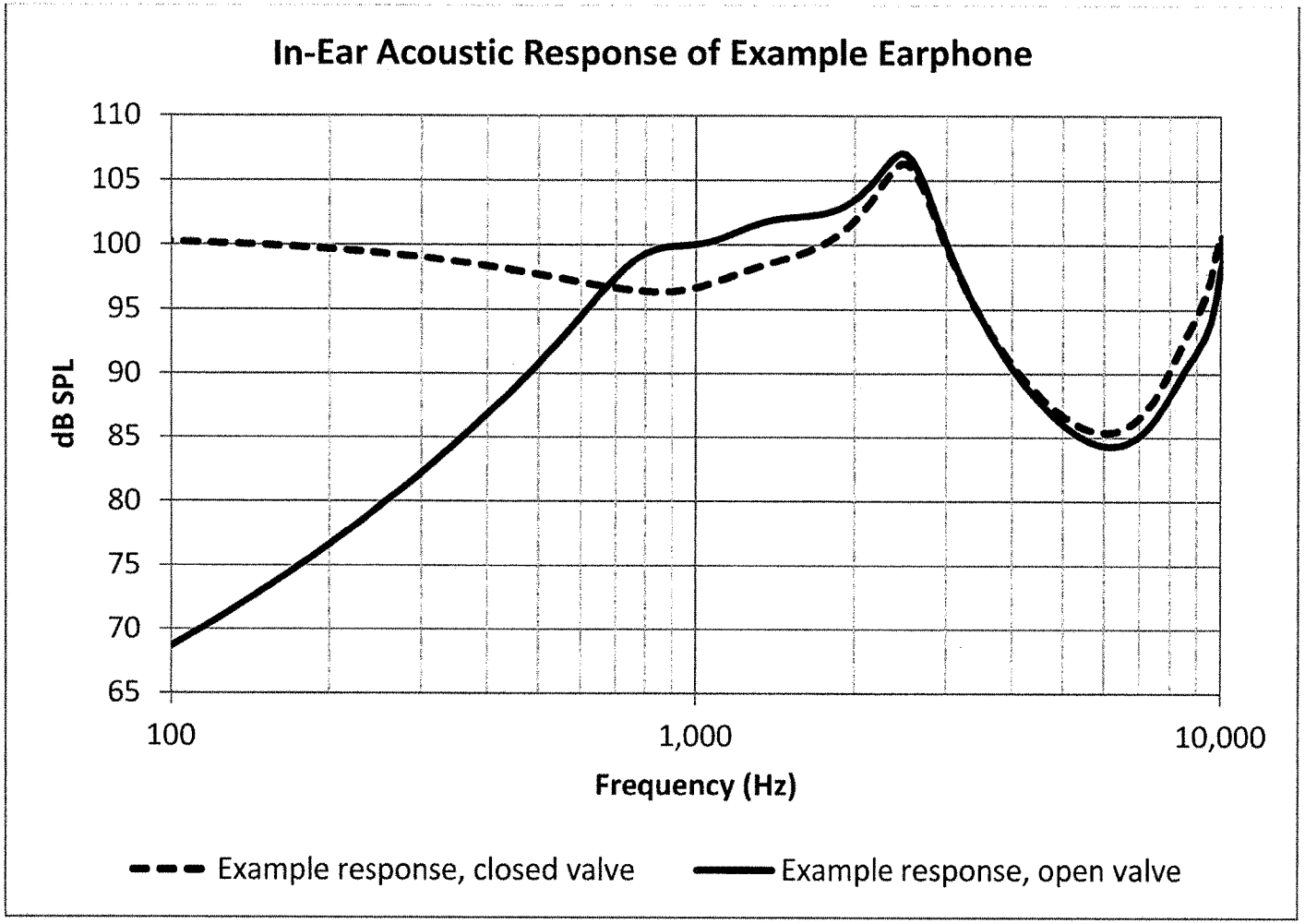
FIG. 4 is a diagram illustrating an example of an in-ear acoustic response control of a hearing device.
Figure 5:
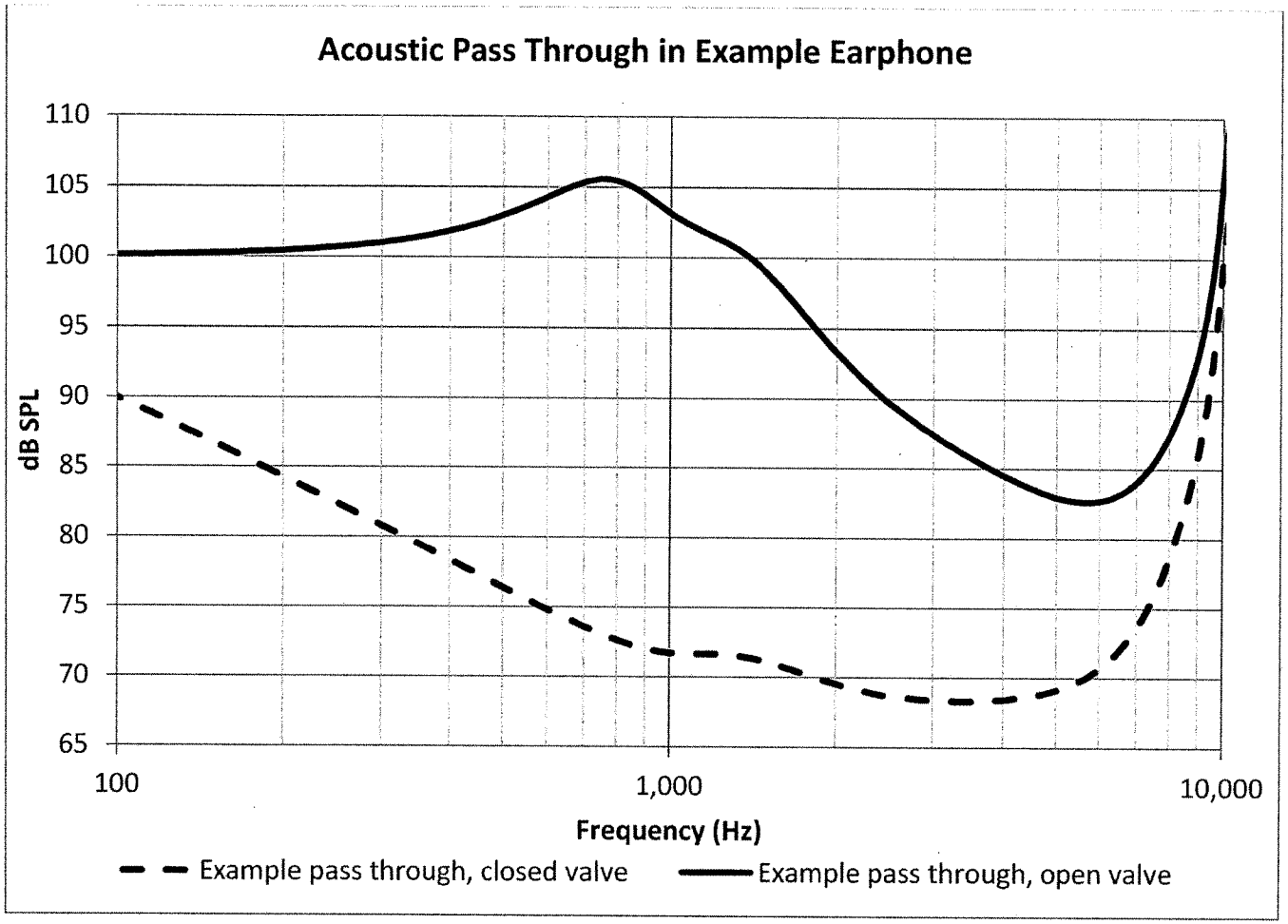
FIG. 5 is a diagram illustrating an example of acoustic pass through of a hearing device.

Referring also to FIG. 4, in one example, an equalizer 400 equalizes the acoustic signal generated by the speaker based on the state of the acoustic valve. This can include changing the frequency dependent phase and/or amplitude of the excitation signal 142. For example, when the valve is open the acoustic response of the acoustic device may be attenuated at lower frequencies (e.g., below 700 Hz) and may have an increased response at higher frequencies (e.g., above 700 Hz to 10,000 Hz) solid plot) compared to when the valve is closed (broken plot). The goal in this example is to compensate for attenuation of the lower frequencies when the valve is in the open state. More generally, the processor can apply different equalizations for when the valve is in the open and closed states. The desired response in an open state may not be identical to the desired response in a closed state. In another use case, the processor may increase the response in at some frequencies to improve clarity of received telephony speech when the valve state is open, thereby keeping parts of speech above the level of background noise entering through the valve. As such, the electrical circuit is operative to change the state of the acoustic valve and to provide adaptive audio signal processing based on the state of the acoustic valve by changing the equalization of the outgoing audio signal.

In another implementation, the controller 314, which may be located in a housing of the hearable, in a BTE unit of a RIC hearing device, or other location, includes an active noise cancellation (ANC) module 402 which executes ANC algorithms, such that at least one microphone coupled to the electrical circuit is used and the processor implements an active noise cancellation (ANC) algorithm. The processor configures ANC based on the state of the acoustic valve. For example, the processor may configure the ANC algorithm to operate in a feedforward only mode when the acoustic valve is in a particular state, e.g., in an open state. In other examples, the processor enables ANC in response to signals received by the microphone 152, such that the ANC module stops cancelling frequencies below a low frequency cutoff for a particular valve state, e.g., when acoustic valve is in an open state. In another example, the processor turns off ANC based on the valve state, e.g., when the acoustic valve is in an open state. In another example, the ANC module produces a signal to at least partially cancel an audible artifact caused by the valve changing states, the signal may be prerecorded or determined from a microphone input, Referring to FIG. 5, in another implementation, the processor employs a pass through module 404 that uses input from the microphone 152 to pass sound signals from the microphone to the sound producing speaker 104 based on a state of the acoustic valve. For example, in the open state much more sound can pass through to a user's ear drum naturally but there may be extra sound in some mid-range frequencies (example graph is 200 Hz to 1500 Hz) and reduced pass through in a higher range (1500 Hz to 10,000 Hz). Active (electronic) pass through can augment those frequencies not naturally passed as well. For example, frequencies from about 400 Hz up to about 5000 Hz are useful for understanding speech. In one use case, the processor produces active pass through frequencies for the speaker to augment from about 1000 Hz to at least 5000 Hz. Also, the use of the microphone may occur when the valve is in the closed state. For example, either for ambient awareness in a music headphone, or voice amplification in a hearing assistive device or hearing aid. The signal may be selectively passed from the mic to the speaker, such as only when someone is speaking, or only when a safety hazard or alarm is detected. When listening to music quietly it may be desired to have electronic pass through while the valve is closed in order to provide the user with some sense of the ambient environment while still maintaining improved music quality that is possible with a closed valve. For example, the controller enhances frequencies of the audio signal that are most attenuated by the closed acoustic valve.

As noted above, a sensor 150 can be employed to output a signal indicative of the state of the acoustic valve. The processor uses this signal to determine the state of the valve in one example. In other implementations no sensor is needed.

In another implementation, echo cancellation module 406 is employed which is an echo-cancellation algorithm implemented by the processor, wherein the processor controls echo using the echo-cancellation algorithm based on the state of the acoustic valve. For example, when the valve is open more sound produced by the speaker will leak out of the ear and reach external microphone(s). Sound from speaker may be picked up by the microphone. This signal is reduced by the echo canceller 406, so the person at the far end of the phone conversation will not hear their own voice after passing through the local headset. Echo cancelling is also used to remove any speaker sound leaking into the microphone signal to improve effectiveness of a voice recognition system, further described below.

In another example, the processor implements a power control algorithm, wherein the processor controls power consumption of the hearing device using the power control algorithm based on the state of the acoustic valve. In one example the processor, turns off echo cancelling operation when the valve is closed in order to save power. In other examples, the valve may be opened to allow hearing ambient sounds without needing to remove the hearing device. In that open state, the microphone 152 and much of the other equipment in the hearable may not need to be active. Power is selectively shut down to inactive or less active devices, such as the microphone, the microphone A/D converter, portions of the signal processing circuitry, memory, or the power amplifier. The devices could also be changed to a lower power state, rather than being fully disabled. The lower power state may offer reduced performance in order to reduce power consumption.

In other implementations, the processor includes a noise reduction module 408 that implements a noise reduction algorithm, wherein the noise reduction algorithm is adapted based on the state of the acoustic valve. For example, the noise reduction algorithm may be turned ON or OFF based on valve state. Other characteristics (e.g., latency or aggressiveness among other parameters) of the noise reduction algorithm may also be controlled based on the state of the valve. Sound picked up by the microphone 152 contains both speech and background noise. A noise reduction algorithm can reduce the amount of noise while retaining speech content. This signal can in turn be sent to the local speaker (sound producing speaker), to a voice recognition system, or to a person at the far end of the telephone conversation. The valve is likely to be closed when the wearer's surroundings become noisy. Thus, a valve-closed condition would also tell the system that the need for noise reduction has increased.

In other implementations the device provides beam forming using multiple microphones. The processor implements a beam forming algorithm 409, wherein the processor controls processing of multiple microphone signals using the beam-forming algorithm based on the state of the acoustic valve. For example, if a user closes the valve it may indicate that the user is having difficulty with background noise and understanding a person with whom they are talking. In this case, beam-forming may be configured to mostly sense sound directly in front of the user.

In other implementations the processor implements a speech recognition algorithm 411, wherein the processor adapts a speech recognition model of the algorithm based on the state of the acoustic valve. For example, a state of the valve may be indicative of background noise that can interfere with speech recognition. When the valve is closed, the speech recognition algorithm can be changed to one that is better adapted to noisy speech. Also, some devices may use a microphone in the ear canal to pick up a portion of the user's speech. When the valve is open, the low frequency content of the in-canal speech may be will be much lower, so the speech recognition module could be adapted to compensate for it.

Users may also tend to speak differently when the valve is open than closed. Users will commonly speak more quietly when the valve is closed if their own voice sounds amplified. As a result, the sensitivity of the voice recognition software increases when the valve is closed, particularly if the algorithm relies heavily or exclusively on the external microphone only.

In other implementations the processor implements a feedback suppression algorithm, wherein the processor adapts the feedback suppression in response to the state of the valve. For example, when the valve is open sound from the speaker will more readily reach an external microphone or the frequency response measured at the microphone may change. As a result, the feedback suppression may benefit from adapting to the new acoustics. Alternatively, the feedback suppression may be turned off when the valve is closed to conserve power.

Figure 6:
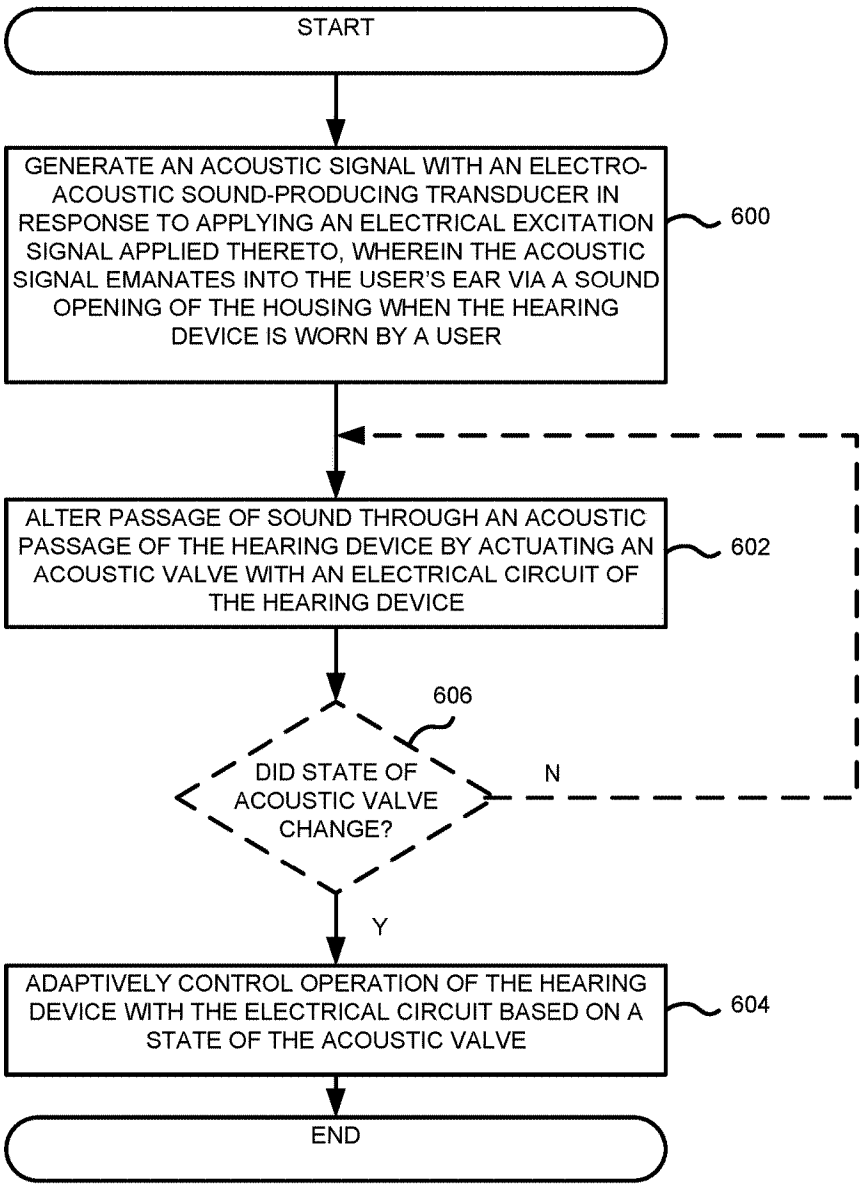
FIG. 6 is flowchart illustrating one example of a method in a hearing device.

FIG. 6 illustrates a method in a hearing device that includes a housing having a contact portion configured to form a substantially sealed coupling with a user's ear, the housing having a sound opening. The method includes, as shown in block 600, generating an acoustic signal with an electro-acoustic speaker in response to applying an electrical excitation signal 142 applied thereto, wherein the acoustic signal emanates into the user's ear via a sound opening of the housing when the hearing device is worn by a user. This is done by the electrical circuit 110. As shown in block 602 the method includes altering passage of sound through an acoustic passage of the hearing device by actuating an acoustic valve 108 with an electrical circuit 110 of the hearing device. The method includes, as shown in block 604 controlling operation of the hearing device with the electrical circuit 110 based on a state of the acoustic valve. If desired the method may include determining if the state of the valve has changed as shown in block 606. This may be done via sensor detection as describe above or when the valve activation signal 161 causes a state change for example.

Figure 3:
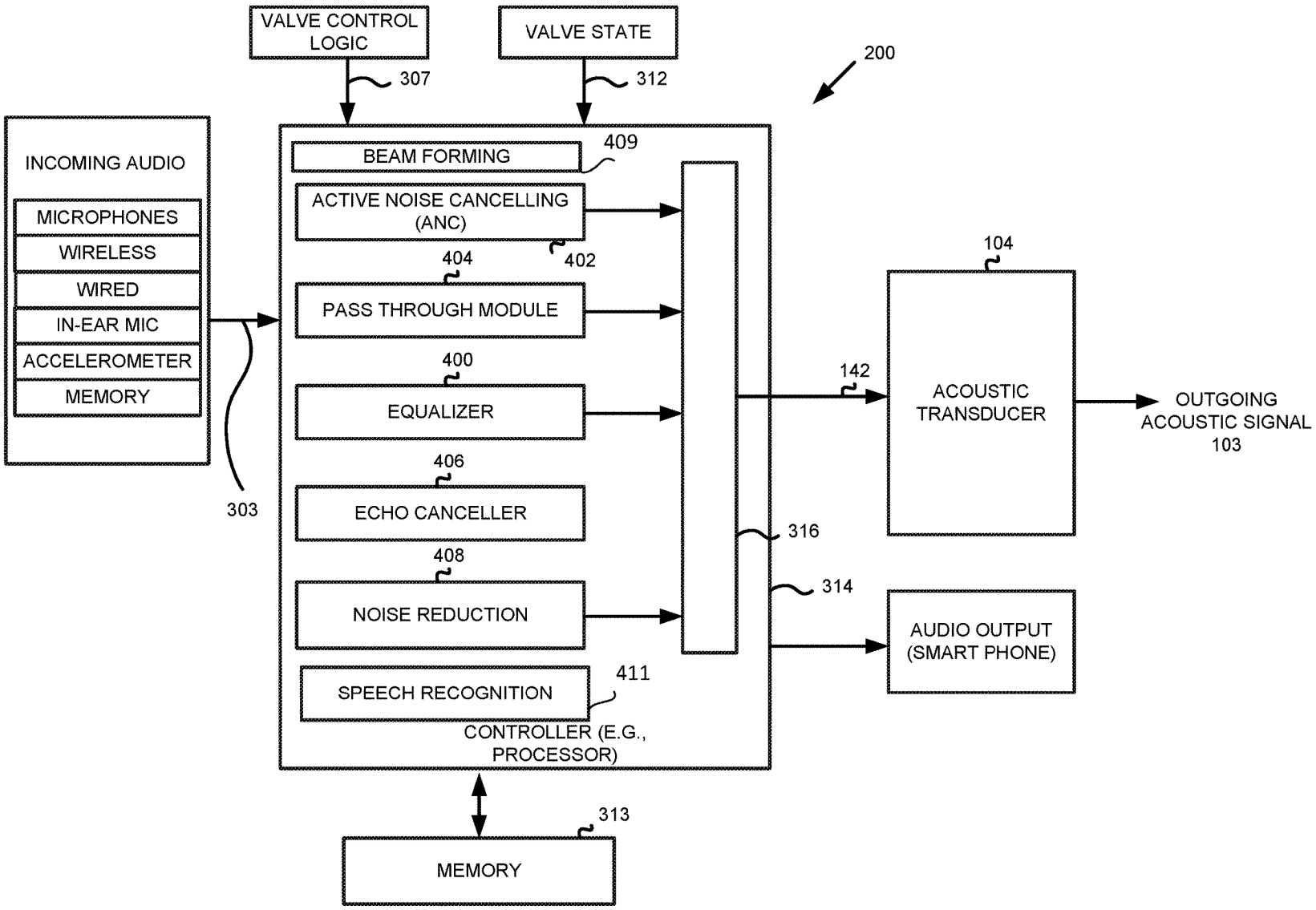
FIG. 3 is a schematic block diagram of a portion of a hearing device.

As noted above, in one example, the electrical circuit 110 responds to a valve state change and then changes operation of the hearing device. In one example, the modules and components shown in FIG. 3 are implemented as a processor executing executable instructions stored in memory 313, such as RAM, ROM or other memory, that when executed by the processor 314, cause the processor to carry out the processes as described. It will be recognized that the ANC, EQ, Echo Cancellation, Noise Reduction, Feedback Suppression and signal Pass Through operations of processor 314 are known techniques that are adjusted in ways that improve performance of the hearing device in response to the acoustic valve state and/or improve the operation of the hearing device based on a state of the surrounding environment that can be inferred from the state of the valve. Where more than one of the operations 400-408 are employed, a switch 316 is used, if desired, to provide interconnection to the acoustic speaker. However, it will be recognized that any suitable single or combination of operations may be employed.

While the present disclosure and what is presently considered to be the best mode thereof has been described in a manner that establishes possession by the inventors and that enables those of ordinary skill in the art to make and use the same, it will be understood and appreciated that in light of the description and drawings there are many equivalents to the exemplary embodiments disclosed herein and that myriad modifications and variations may be made thereto without departing from the scope and spirit of the disclosure, which is to be limited not by the exemplary embodiments but by the appended claimed subject matter and its equivalents.

What is claimed is:

1. A hearing device comprising:

a housing having a contact portion configured to form a substantially sealed coupling with a user's ear, the housing having a sound opening;

a sound-producing electroacoustic transducer disposed in the housing, the sound producing transducer configured to generate an acoustic signal in response to an electrical excitation signal applied thereto, wherein an acoustic signal generated by the sound producing transducer emanates into the user's ear via the sound opening when the portion of the housing is coupled to the user's ear;

an acoustic valve disposed in an acoustic passage of the housing, the acoustic valve actuatable between two or more states by an electrical circuit to alter passage of sound through the acoustic passage; and a sensor coupled to the electrical circuit and configured to generate an output signal indicative of a state of the acoustic valve, wherein the electrical circuit is configured to control operation of the hearing device based on the state of the acoustic valve.

2. The hearing device of claim 1, the electrical circuit includes a processor, wherein the processor is configured to control operation by adapting the electrical excitation signal applied to the sound producing transducer based on the state of the acoustic valve.

3. The hearing device of claim 1, wherein the electrical circuit is operative to equalize the acoustic signal generated by the sound producing transducer based on the state of the acoustic valve.

4. The hearing device of claim 1 further comprising at least one microphone coupled to the electrical circuit, the electrical circuit including a processor that implements an active noise cancellation (ANC) algorithm, wherein the processor configures ANC based on the state of the acoustic valve.

5. The hearing device of claim 4, wherein the processor configures ANC in a feedforward only mode when the acoustic valve is in an open state.

6. The hearing device of claim 1 further comprising a microphone coupled to the electrical circuit, wherein the electrical circuit includes a processor configured to pass sound signals from the microphone to the sound-producing electroacoustic transducer based on the state of the acoustic valve.

7. The hearing device of claim 1, wherein the electrical circuit includes a processor that enhances frequencies of the audio signal corresponding to acoustic signals that are attenuated by the acoustic valve based on the state of the acoustic valve.

8. The hearing device of claim 1, the electrical circuit includes a processor that implements an echo-cancellation algorithm implemented by the electrical circuit, wherein the processor controls echo using the echo-cancellation algorithm based on the state of the acoustic valve.

9. The hearing device of claim 1, the electrical circuit includes a processor that implements a noise reduction algorithm, wherein the processor controls noise using the noise reduction algorithm based on the state of the acoustic valve.

10. The hearing device of claim 1, the electrical circuit including a processor that implements a power control algorithm, wherein the processor controls power consumption of the hearing device using the power control algorithm based on the state of the acoustic valve.

11. The hearing device of claim 1, the electrical circuit including a processor that implements a sound level control algorithm, wherein the processor controls a sound level of the sound-producing electroacoustic transducer using the sound level control algorithm based on the state of the acoustic valve.

12. The hearing device of claim 1, the electrical circuit including a processor that implements a speech recognition algorithm, wherein the processor adapts a speech recognition model of the speech recognition algorithm based on the state of the acoustic valve.

13. The hearing device of claim 1, the electrical circuit including an audio signal output connectable to an external device, wherein the electrical circuit controls an audio signal of the audio signal output based on the state of the acoustic valve.

14. The hearing device of claim 1 further comprising at least one microphone coupled to the electrical circuit, the electrical circuit including a processor that implements a feedback suppression algorithm, wherein the processor configures feedback suppression based on the state of the acoustic valve.

15. A method in a hearing device including a housing having a contact portion configured to form a substantially sealed coupling with a user's ear, the housing having a sound opening, the method comprising:

generating an acoustic signal with an electro-acoustic sound-producing transducer in response to applying an electrical excitation signal applied thereto, wherein the acoustic signal emanates into the user's ear via a sound opening of the housing when the hearing device is worn by a user;

altering passage of sound through an acoustic passage of the hearing device by actuating an acoustic valve with an electrical circuit of the hearing device;

determining a state of the acoustic valve; and controlling operation of the hearing device with the electrical circuit based on a state of the acoustic valve.

16. The method of claim 15, adapting the electrical excitation signal applied to the sound producing transducer based on the state of the acoustic valve.

17. The method device of claim 15, equalizing the acoustic signal generated by the sound producing transducer based on the state of the acoustic valve.

18. The method of claim 15, the hearing device further comprising a microphone coupled to the electrical circuit, configuring active noise cancellation (ANC) implemented by the electrical circuit based on the state of the acoustic valve.

19. The method of claim 18, configuring ANC in a feedforward only mode when the acoustic valve open.

20. The method of claim 15, the hearing device further comprising a microphone coupled to the electrical circuit, passing sound signals from the microphone to the sound-producing electroacoustic transducer based on the state of the acoustic valve.

21. The method of claim 15, enhancing frequencies of the audio signal corresponding to acoustic signals that are attenuated by the acoustic valve based on the state of the acoustic valve.

22. The method of claim 15, controlling echo with an echo-cancellation algorithm implemented by the electrical circuit based on the state of the acoustic valve.

23. The method of claim 15, controlling noise using a noise reduction algorithm implemented by the electrical circuit based on the state of the acoustic valve.

24. The method of claim 15, controlling power consumption of the hearing device using a power control algorithm implemented by the electrical circuit based on the state of the acoustic valve.

25. The method of claim 15, the hearing device further comprising multiple microphones, controlling the processing of at least one microphone signal using a beam-forming algorithm implemented by the electrical circuit based on the state of the acoustic valve.

26. The method of claim 15, controlling a sound level of the sound-producing electroacoustic transducer using a sound level control algorithm implemented by the electrical circuit based on the state of the acoustic valve.

27. The method of claim 15, adapting a speech recognition model of a speech recognition algorithm implemented by the electrical circuit based on the state of the acoustic valve.

28. The method of claim 15, controlling an audio signal output by the electrical circuit based on the state of the acoustic valve.

29. A hearing device comprising:

a housing having a contact portion configured to form a substantially sealed coupling with a user's ear, the housing having a sound opening;

a sound-producing electroacoustic transducer disposed in the housing, the sound producing transducer configured to generate an acoustic signal in response to an electrical excitation signal applied thereto, wherein an acoustic signal generated by the sound producing transducer emanates into the user's ear via the sound opening when the portion of the housing is coupled to the user's ear;

an acoustic valve disposed in an acoustic passage of the housing, the acoustic valve actuatable between two or more states by an electrical circuit to alter passage of sound through the acoustic passage;

the electrical circuit configured to control operation of the hearing device based on a state of the acoustic valve; and the electrical circuit including a processor that implements a beam forming algorithm, wherein the processor controls processing of at least one microphone signal using the beam-forming algorithm based on the state of the acoustic valve.

30. A method in a hearing device including a housing having a contact portion configured to form a substantially sealed coupling with a user's ear, the housing having a sound opening, the method comprising:

generating an acoustic signal with an electro-acoustic sound-producing transducer in response to applying an electrical excitation signal applied thereto, wherein the acoustic signal emanates into the user's ear via a sound opening of the housing when the hearing device is worn by a user;

altering passage of sound through an acoustic passage of the hearing device by actuating an acoustic valve with an electrical circuit of the hearing device;

controlling operation of the hearing device with the electrical circuit based on a state of the acoustic valve; and the hearing device comprising multiple microphones, the method further comprising controlling the processing of at least one microphone signal using a beam-forming algorithm implemented by the electrical circuit based on the state of the acoustic valve.

* * * * *